US011300896B2

(12) United States Patent
Abe et al.

(10) Patent No.: US 11,300,896 B2
(45) Date of Patent: Apr. 12, 2022

(54) IMAGE FORMING APPARATUS

(71) Applicant: CANON KABUSHIKI KAISHA, Tokyo (JP)

(72) Inventors: Katsuichi Abe, Kanagawa (JP); Masataka Mochizuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/180,118

(22) Filed: Feb. 19, 2021

(65) Prior Publication Data

US 2021/0263439 A1 Aug. 26, 2021

(30) Foreign Application Priority Data

Feb. 26, 2020 (JP) ..... JP2020-030499

(51) Int. Cl.
*G03G 15/08* (2006.01)
*G03G 15/02* (2006.01)
*G03G 15/06* (2006.01)

(52) U.S. Cl.
CPC ..... *G03G 15/0266* (2013.01); *G03G 15/065* (2013.01); *G03G 15/0808* (2013.01); *G03G 15/0877* (2013.01)

(58) Field of Classification Search
CPC ..... G03G 15/0266; G03G 15/065; G03G 15/0808; G03G 15/0877
See application file for complete search history.

(56) References Cited

U.S. PATENT DOCUMENTS 6,282,385 B1 * 8/2001 Suto ..... G03G 15/065 399/282
2007/0206976 A1 * 9/2007 Matsuura ..... G03G 15/0808 399/273
2007/0280738 A1 * 12/2007 Uetake ..... G03G 15/0891 399/253
2008/0152387 A1 * 6/2008 Kubo ..... G03G 21/0064 399/150
2015/0261123 A1 * 9/2015 Mitsui ..... G03G 15/0808 399/285
2018/0292773 A1 * 10/2018 Kihara ..... G03G 15/50

FOREIGN PATENT DOCUMENTS

JP 11242382 A * 9/1999 ..... G03G 15/0818
JP 2006084598 A 3/2006
JP 4364485 B2 11/2009
JP 2011039555 A 2/2011
JP 2016126247 A 7/2016
JP 2016130827 A 7/2016
JP 2018180522 A 11/2018

* cited by examiner

*Primary Examiner* — Sevan A Aydin
(74) *Attorney, Agent, or Firm* — Canon U.S.A., Inc. I.P. Division

(57) ABSTRACT

An image forming apparatus includes a main assembly, a first cartridge including an image bearing member, a second cartridge including a developing member, a developer supplying member provided in the second cartridge, and a controller for changing a polarity of a developer supply amount control bias which is a difference between the developing bias and the developer supplying bias depending on a print ratio based on an inputted image data. The controller changes the polarity of the developer supply amount control bias depending on at least one of a use history of the first cartridge and a use history of the second cartridge and on the print ratio.

8 Claims, 16 Drawing Sheets

| | EMB. 1 | | COMP. EX. 1 | | COMP. EX. 2 | |
|---|---|---|---|---|---|---|
| PRINT RATIO | LOW | HIGH | LOW | HIGH | LOW | HIGH |
| ΔSUPPLY BIAS | (+) | (−) | (−) | (−) | (+) | (+) |
| IMPROPER CLEANING | OK | OK | OCCURRED | OK | OK | OK |
| IMPROPER SOLID FOLLOWABILITY | OK | OK | OK | OK | OK | OCCURRED |

| | EMB. 1 | | COMP. EX. 1 | | COMP. EX. 2 | |
|---|---|---|---|---|---|---|
| PRINT RATIO | LOW | HIGH | LOW | HIGH | LOW | HIGH |
| ΔSUPPLY BIAS | (+) | (−) | (−) | (−) | (+) | (+) |
| IMPROPER CLEANING | OK | OK | OCCURRED | OK | OK | OK |
| IMPROPER SOLID FOLLOWABILITY | OK | OK | OK | OK | OK | OCCURRED |

Fig. 8

| EMB. 2 | FRESH DRUM CARTRIDGE | | USED DRUM CARTRIDGE | |
|---|---|---|---|---|
| | LOW P.R. | HIGH P.R. | LOW P.R. | HIGH P.R. |
| FRESH DEVELOPING CARTRIDGE | (−) | (−) | (+) | (−) |
| USED DEVELOPING CARTRIDGE | (+) | (−) | (+) | (−) |

Fig. 12

| EMB. 2 | FRESH DRUM CARTRIDGE | | USED DRUM CARTRIDGE | |
|---|---|---|---|---|
| | LOW P. R. | HIGH P. R. | LOW P. R. | HIGH P. R. |
| FRESH DEVELOPING CARTRIDGE | (−) | (−) | (+) | (−) |
| | OK | OK | OK | OK |
| USED DEVELOPING CARTRIDGE | (+) | (−) | (+) | (−) |
| | OK | OK | OK | OK |

Fig. 14

| COMP. EX. 3 | FRESH DRUM CARTRIDGE | | USED DRUM CARTRIDGE | |
|---|---|---|---|---|
| | LOW P. R. | HIGH P. R. | LOW P. R. | HIGH P. R. |
| FRESH DEVELOPING CARTRIDGE | (—) | (—) | (—) | (—) |
| | OK | OK | IC *1 | OK |
| USED DEVELOPING CARTRIDGE | (—) | (—) | (—) | (—) |
| | OK | OK | IC *1 | OK |

*1:"IC" is the improper cleaning.

Fig. 15

| COMP. EX. 4 | FRESH DRUM CARTRIDGE | | USED DRUM CARTRIDGE | |
|---|---|---|---|---|
| | LOW P. R. | HIGH P. R. | LOW P. R. | HIGH P. R. |
| FRESH DEVELOPING CARTRIDGE | (+) | (+) | (+) | (+) |
| | TUOB *1 | ISF *2 | OK | ISF *2 |
| USED DEVELOPING CARTRIDGE | (+) | (+) | (+) | (+) |
| | OK | ISF *2 | OK | ISF *2 |

*1:"TUOB" is turning-up of the blade.

*2:"ISF" is improper solid followability.

Fig. 16

IMAGE FORMING APPARATUS

FIELD OF THE INVENTION AND RELATED ART

The present invention relates to an image forming apparatus of an electrophotographic type, such as a copying machine, a printer or a facsimile machine.

Conventionally, in the image forming apparatus of the electrophotographic type such as the copying machine or the laser beam printer, a photosensitive drum as an image bearing member is electrically charged uniformly by a charging member, and thereafter the charged photosensitive drum is irradiated with light corresponding to image information, so that an electrostatic latent image is formed. Further, the image forming apparatus develops the electrostatic latent image into a toner image by using a developing roller as a developing member and then transfers the toner image onto a recording material (medium) such as recording paper by a transfer member, so that an image is formed on the recording material. Then, the image forming apparatus removes toner remaining on the photosensitive drum by a cleaning device such as a cleaning blade.

Here, the image forming apparatus of the electrophotographic type includes the copying machine, the printer (the laser beam printer, LED printer or the like), the facsimile apparatus, a word processor or a multi-function machine (multi-function printer or the like) of these machines.

Further, conventionally, in the above-described image forming apparatus, a state called improper cleaning such that the toner is not properly cleaned by the cleaning blade is formed depending on a particle size of the toner on the photosensitive drum is formed in some instances. Particularly, in the case where the particle size of the toner on the developing member is small, the particle size of the toner on the photosensitive drum also becomes small, and therefore, in the case where images with a low-print ratio are repetitively, there is a possibility that the improper cleaning occurs.

A fine powder ratio of the toner on the developing member changes depending on a magnitude of a difference between a developing bias applied to the developing member and a supplying bias applied to a developer supplying member, and becomes higher with a larger value of this difference, for example. Accordingly, with a larger difference between the developing bias and the supplying bias, there is a higher possibility of occurrence of the improper cleaning. Here, the fine powder ratio refers to a ratio of the number of toner particles of less than a predetermined value in circle-corresponding diameter to the number of all the toner particles.

On the other hand, in the case where the difference between the developing bias and the supplying bias is small, when an image with a high-print ratio is printed, it becomes difficult to supply the toner from the developer supplying member to the developing member. Accordingly, in the case where the image with the high-print ratio is printed when the difference between the developing bias and the supplying bias is small, a supply amount of the toner to the electrostatic latent image on the photosensitive drum becomes insufficient, so that improper solid followability by which a desired image density cannot be obtained occurs.

In such a situation, Japanese Patent No. 4364485 discloses an image forming apparatus in which the difference between the developing bias and the supplying bias is made large when the image density is high and is made small when the image density is low.

However, in Japanese Patent No. 4364485, when a magnitude of the difference between the developing bias and the supplying bias is only changed, the particle size of the toner on the developing member does not change conspicuously. Accordingly, in Japanese Patent No. 4364485, a fine powder ratio of the toner on the developing member cannot be sufficiently suppressed, so that there is a possibility that improper cleaning of the image bearing member occurs.

SUMMARY OF THE INVENTION

A principal object of the present invention is to provide an image forming apparatus capable of suppressing, for example, improper cleaning of an image bearing member and improper solid followability by changing a polarity of a difference between a developing bias and a supplying depending on a print ratio.

According to an aspect of the present invention, there is provided an image forming apparatus comprising: a main assembly; a first cartridge including an image bearing member on which an electrostatic latent image based on image data inputted from an outside, the first cartridge being mountable in and dismountable from the main assembly; a second cartridge including a developing member for developing the electrostatic latent image with a developer under application of a developing bias, the second cartridge being mountable in and dismountable from the main assembly; a developer supplying member provided in the second cartridge and configured to supply the developer to the developing member under application of a developer supplying bias; and a controller configured to change a polarity of a developer supply amount control bias which is a difference between the developing bias and the developer supplying bias depending on a print ratio based on the inputted image data, wherein the controller changes the polarity of the developer supply amount control bias depending on at least one of a use history of the first cartridge and a use history of the second cartridge and on the print ratio.

Further features of the present invention will become apparent from the following description of exemplary embodiments with reference to the attached drawings.

BRIEF DESCRIPTION OF THE DRAWINGS

FIG. 8 is a table comparing effects of the image forming apparatus according to the embodiment 1 with effects of image forming apparatuses according to comparison examples 1 and 2.

FIG. 12 is a table showing a relationship between use states of cartridges, print ratios and polarities of the Δ supplying bias in the image forming apparatus according to the embodiment 2.

FIG. 14 is a table showing an effect of the image forming apparatus in the embodiment 2.

FIG. 15 is a table showing an effect of a comparison example 3 in comparison with the effect of the image forming apparatus in the embodiment 2.

FIG. 16 is a table showing an effect of a comparison example 4 in comparison with the effect of the image forming apparatus in the embodiment 2.

DESCRIPTION OF THE EMBODIMENTS

Figure 1:
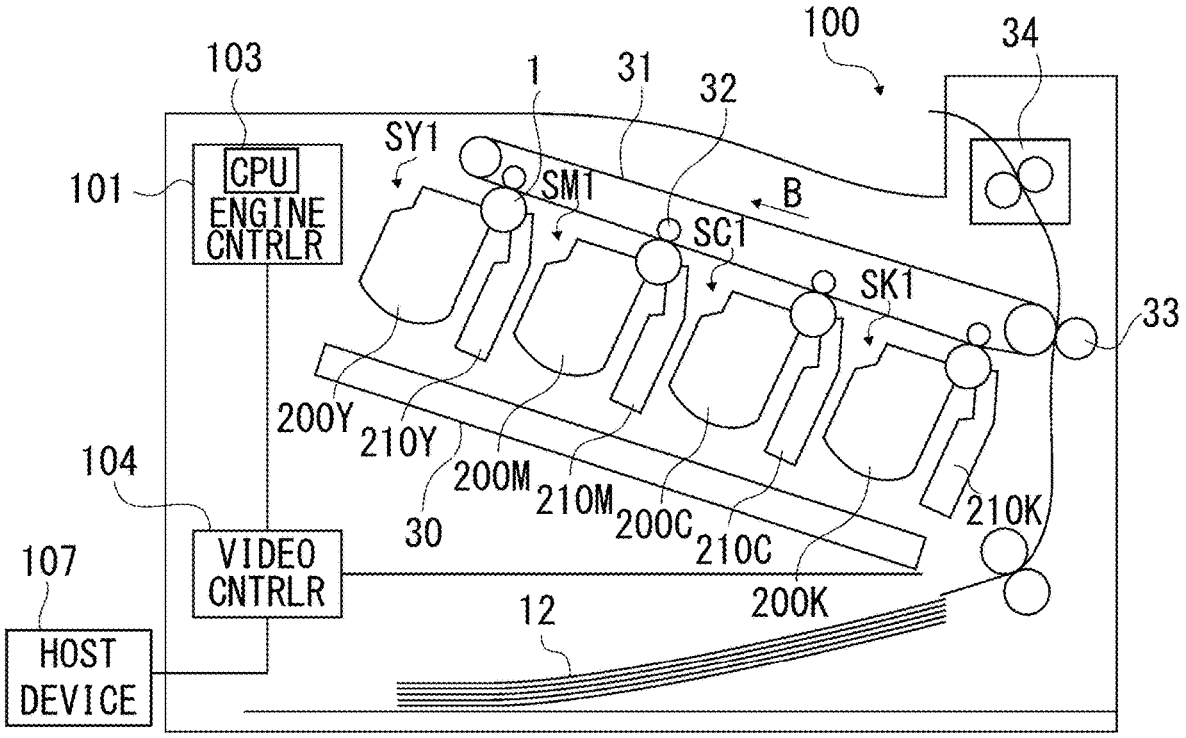
FIG. 1 is a schematic view of an image forming apparatus according to an embodiment 1.

Hereinafter, embodiments will be described with reference to the drawings.

Embodiment 1

<Image Forming Apparatus>

A structure of an image forming apparatus 100 according to an embodiment 1 of the present invention will be specifically described with reference to FIGS. 1 and 2.

The image forming apparatus 100 is an electrophotographic image forming apparatus employing an in-line type and an intermediary transfer type, including an electrophotographic copying machine, an electrophotographic printer such as an LED printer or a laser beam printer, and an electrophotographic facsimile apparatus. The image forming apparatus 100 forms an image on a recording material 12 such as a recording sheet, a plastic sheet or a cloth in accordance with image information by using, for example, an electrophotographic image forming process.

Specifically, the image forming apparatus 100 includes a scanner unit 30, an intermediary transfer belt 31, primary transfer rollers 32, a secondary transfer roller 33 and a fixing portion 34. Further, the image forming apparatus 100 includes an engine controller 101, a CPU 103, a video controller 104, a developing bias applying voltage source 105, a developer supplying bias applying voltage source 106, and image forming portions SY1, SM1, SC1 and SK1.

The scanner unit 30 is an exposure device provided at a periphery of photosensitive drums 1 of the image forming portions SY1, SM1, SC1 and SK1, and forms electrostatic images (electrostatic latent images) by irradiating surfaces of the photosensitive drums 1 with laser light on the basis of image information. The scanner unit 30 starts laser light exposure from a position indicated by a positional signal in a polygon scanner, which is called BD for every line with respect to a main scan direction perpendicular to a feeding direction of the recording material 12.

Further, the scanner unit 30 starts the laser light exposure at timing when with respect to a sub-scan direction which is the same difference as the feeding direction of the recording material 12, a predetermined time is delayed from a TOP signal with an unshown switch, as a starting point, in a feeding passage of the recording material 12. By this, the scanner unit 30 is capable of performing the laser light exposure always in the same position on the photosensitive drum 1 in each of the image forming portions SY1, SM1, SC1 and SK1 which are four process stations.

The intermediary transfer belt 31 is formed with an endless belt and contacts all the photosensitive drums 1, and moves (rotates) in an arrow B direction (counterclockwise direction). The intermediary transfer belt 31 is an intermediary transfer member for transferring a toner image from the photosensitive drum 1 onto the recording material 12.

Each of the primary transfer rollers 32 is a primary transfer means provided opposed to the associated photosensitive drum 1 through the intermediary transfer belt 31 on an inner peripheral surface side of the intermediary transfer belt 31. To the primary transfer roller 32, a bias of a polarity opposite to a normal charge polarity of the toner is applied from an unshown primary transfer bias voltage source (high-voltage source). The primary transfer roller 32 transfers (primary transfers) the toner image from the photosensitive drum 1 onto the intermediary transfer belt 31 under application of the bias from the primary transfer bias voltage source.

The primary transfer rollers 32 successively primary-transfer superposedly, onto the intermediary transfer belt 31, the respective color toner images formed on the photosensitive drums 1 by predetermined processes successively performed in the image forming portions SY1, SM1, SC1 and SK1 during full-color image formation.

The secondary transfer roller 33 is a secondary transfer means provided on an outer peripheral surface side of the intermediary transfer belt 31 and contacts the recording material 12 toward the intermediary transfer belt 31. To the secondary transfer roller 33, a bias of a polarity opposite to the normal charge polarity of the toner is applied from an unshown secondary transfer bias voltage source (high-voltage source). The secondary transfer roller 33 transfers (secondary-transfers) the toner images from the intermediary transfer belt 31 onto the recording material 12 fed in synchronism with movement of the intermediary transfer belt 31 under application of the bias from the secondary transfer bias voltage source. The secondary transfer roller 33 secondary-transfers the four color toner images collectively from the intermediary transfer belt 31 onto the recording material 12 during the full-color image formation.

The fixing portion 34 fixes the toner images on the recording material 12, which is fed from the secondary transfer roller 33 and on which the toner images are transferred, under application of heat and pressure.

The engine controller 101 is connected to the video controller 104, the printing bias applying voltage source 105 and the developer supplying bias applying voltage source 106, and includes the CPU 103 as a controller (control means).

The CPU 103 controls drive of the developing bias applying voltage source 105 and the developer supplying bias applying voltage source 106 on the basis of a video signal inputted from the video controller 104 and a signal indicating a print ratio.

The video controller 104 is connected to an image reading apparatus connected to the image forming apparatus 100 or a host device 107 such as a personal computer communicatably connected to the image forming apparatus 100. In this embodiment, the case where the video controller 104 is connected to the host device 107 will be described as an example. The video controller 104 includes an image processing portion 401, a half-tone processing portion 402 and a print ratio calculating portion 403.

The image processing portion 401 develops color image information (image data) of RGB image inputted from the host device 107 to the video controller 104, and then forms a video signal on the basis of the image information (image data) and then outputs the video signal to the engine controller 101.

The half-tone processing portion 402 subjects the image information developed by the image processing portion to half-tone process by dithering or the like and thus converts the image information developed by the image processing portion 401 into dot data. Here, the dot data in binary data including "1" indicating, for example, recording of dot and "0" indicating, for example, non-recording of dot.

The print ratio is calculated on the basis of the image data inputted from the external host device 107. Specifically, the print ratio calculating portion 403 calculates the print ratio on the basis of the dot data converted by the half-tone processing portion 402 and outputs the calculated print ratio to the engine controller 101. Here, the print ratio is a value indicating a ratio of the number of dots, subjected to laser irradiation (light irradiation), to the number of total dots corresponding to a printable region of one page.

Further, how large amount of the developer (toner) is actually formed on the photosensitive drum 1 through development of the electrostatic latent image or low large amount of the developer is actually transferred varies depending on an environment. Accordingly, the print ratio acquired from the image data is appropriately corrected depending on the environment (temperature, humidity or use situation of each part), and then the corrected value may also be used as the print ratio.

Further, the print ratio actually employed is not limited thereto, but may also be an average print ratio in an entire print job, an average print ratio in a certain period, or an average print ratio in a preset number of pages, such as 10 pages. Or, the print ratio calculating portion 403 calculates an average print ratio in each of regions in a page, and then the image forming apparatus 100 may execute processes of S5 to S8 of FIG. 7 for each of calculated print ratios.

The printing bias applying voltage source 105 is driven in accordance with control of the CPU 103 of the engine controller 101, and applies the developing bias to a developing roller 4 described later.

The developer supplying bias applying voltage source 106 is driven in accordance with control of the CPU 103 of the engine controller 101, and applies the developer supplying bias to a supplying roller 5 described later.

The image forming portions SY1, SM1, SC1 and SK1 are disposed in a line along a direction crossing a vertical direction and from the toner images of yellow (Y), magenta (M), cyan (C) and black (K), respectively, on the intermediary transfer belt 31. Each of the image forming portions SY1, SM1, SC1 and SK1 is mountable in and dismountable from the image forming apparatus 100 through unshown mounting means such as a mounting guide and a positioning member which are provided in a main assembly of the image forming apparatus 100.

The image forming portions SY1, SM1, SC1 and SK1 are constituted as process cartridges in which developing cartridges (second cartridges) 200Y, 200M, 200C and 200K and drum cartridges (first cartridges) 210Y, 210M, 210C and 210K are integrally assembled, respectively. Here, each of the cartridges refers to a cartridge (unit) which is mountable in and dismountable from the main assembly of the image forming apparatus 100. Incidentally, of the cartridges, the cartridge in which the photosensitive drum 1 and process means actable on the photosensitive drum 1 are integrally assembled is referred is referred to as the drum cartridge. Further, of the cartridges, the cartridge in which process means relating to the development are integrally assembled is referred to as the developing cartridge.

All the developing cartridges 200Y, 200M, 200C and 200K have the same shape. In the developing cartridges 200Y, 200M, 200C and 200K, toners of yellow (Y), magenta (M), cyan (C) and black (K) are accommodated, respectively.

All the drum cartridges 210Y, 210M, 210C and 210K have the same shape.

<Drum Cartridge>

Figure 3:
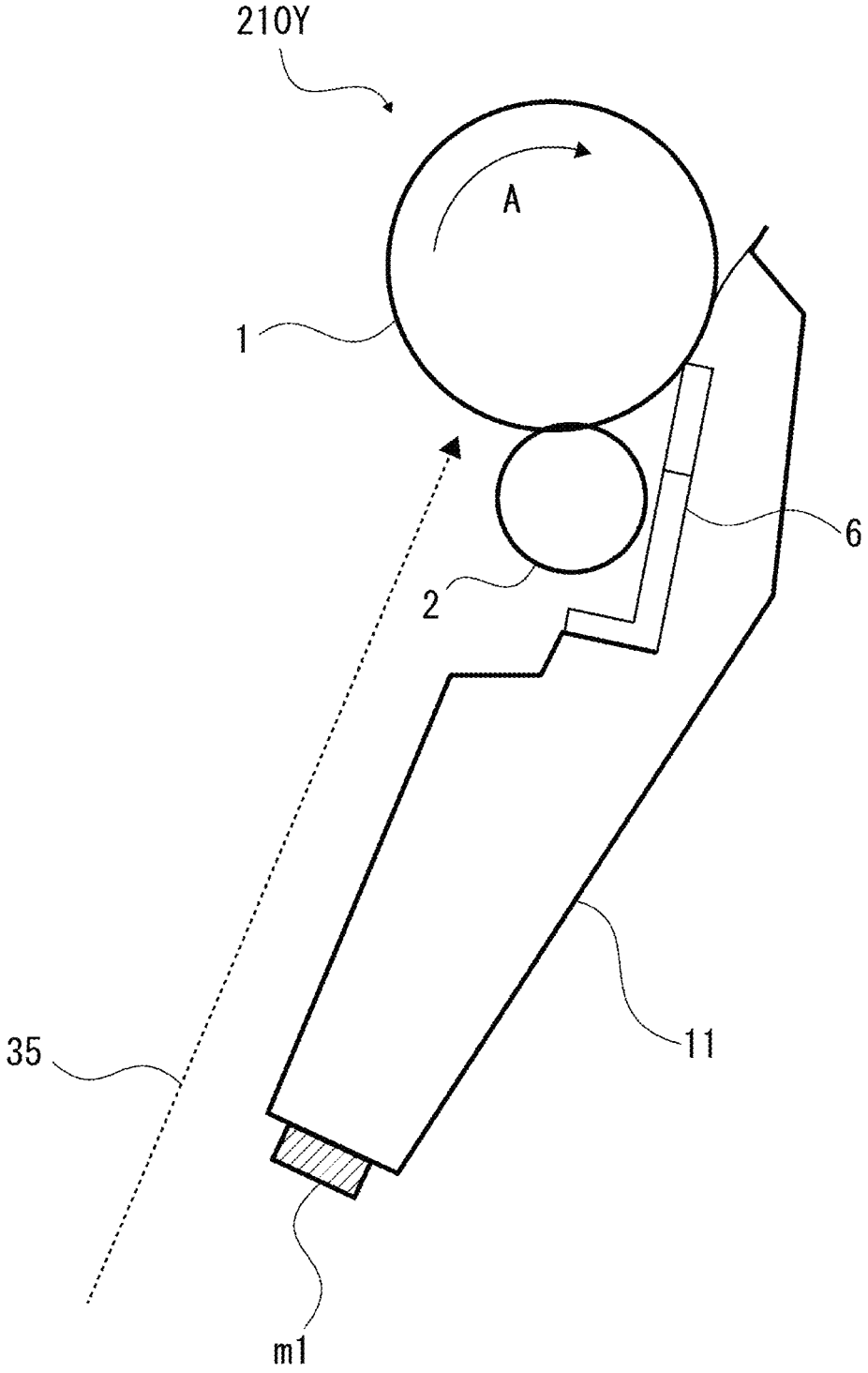
FIG. 3 is a schematic sectional view of a drum cartridge of the image forming apparatus according to the embodiment 1.

A structure of each of the drum cartridges 210Y, 210M, 210C and 210K mounted in the image forming apparatus 100 according to the embodiment 1 of the present invention will be specifically described with reference to FIG. 3. Incidentally, each of the drum cartridges 210Y, 210M, 210C and 210K has the same shape, and therefore, only the structure of the drum cartridge 210Y will be described.

The drum cartridge 210Y includes the photosensitive drum 1, the charging roller 2, a cleaning blade 6, a cleaning frame 11 and a non-volatile memory m1.

The photosensitive drum 1 as an image bearing member is rotatably mounted to the drum cartridge 210Y through unshown bearings. The photosensitive drum 1 is rotationally driven in an arrow A direction of FIG. 3, depending on an image forming operation, by a driving force of an unshown driving motor. The photosensitive drum 1 includes an organic photosensitive member including, on an outer peripheral surface of an aluminum cylinder of 30 mm in diameter, an under-coat layer, a high-resistance layer, a carrier generation layer and a carrier transport layer (CT layer) which are functional layers coated in a named order. Here, the CT layer is gradually abraded by the image forming operation, and therefore, has a film thickness corresponding to a lifetime of the process cartridge, for example, has the thickness of 15 μm.

The photosensitive drum 1 is irradiated with laser light 35, so that an electrostatic image (electrostatic latent image) having a predetermined light-portion potential (Vl) at an irradiation portion of the laser light 35 and a predetermined dark-portion potential (Vd) at a non-irradiation portion of the laser light 35 is formed. At the irradiation portion where the photosensitive drum 1 is irradiated with the laser light 35, electric charges of the surface of the photosensitive drum 1 disappears by the carriers from the carrier generation layer, so that the potential lowers.

The charging roller 2 contacts the outer peripheral surface of the photosensitive drum 1. To the charging roller 2, from an unshown charging bias voltage source (high-voltage source), a charging bias enough to place arbitrary electric charges on the photosensitive drum 1 is applied, and for example, the charging bias of which potential (charge potential Vd) of −500 V on the photosensitive drum 1 is applied.

The cleaning bias 6 is formed with an elastic member and contacts the outer peripheral surface of the photosensitive drum 1. The cleaning bias 6 removes transfer residual toner carried on the outer peripheral surface of the photosensitive drum 1. The cleaning frame 11 accommodates the transfer residual toner removed from the photosensitive drum 1 by the cleaning bias 6.

In the non-volatile memory m1, pieces of information on the number of rotations of the photosensitive drum 1 for grasping a use amount of the drum cartridge 210Y and on a production number and the like are stored. The non-volatile memory m1 contacts the CPU 103 of the engine controller 101 or contacts an electric contact toward the CPU 103, and thus is capable of communicating with the CPU 103, so that writing and reading of the information are carried out.

<Developing Cartridge>

A structure of each of the developing cartridges 200Y, 200M, 200C and 200K which are mounted in the image forming apparatus 100 according to the embodiment 1 of the present invention will be specifically described with reference to FIG. 4. Incidentally, each of the developing cartridges 200Y, 200M, 200C and 200K has the same shape, and therefore, only the structure of the developing cartridge 200Y will be described.

The developing cartridge 200Y includes the developing roller 4, the supplying roller 5, a regulation member 8, a developing chamber 20*a*, a developer accommodating chamber 20*b*, and a developer feeding member 21.

The developing roller 4 is constituted by providing an electroconductive elastic rubber layer having a predetermined volume resistance at a periphery of a core metal and contacts the photosensitive drum 1. The developing roller 4 rotates in an arrow D direction of FIG. 4 by a developing force of an unshown developing motor. To the developing roller 4, a developing bias of a polarity which is the same as the normal charge polarity of toner 9 enough to develop and visualize the electrostatic latent image on the photosensitive drum 1 into the toner image is applied from the developing bias applying voltage source 105.

The supplying roller 5 as a developer supplying member is an elastic sponge roller including a foam member provided on an outer peripheral surface of an electroconductive core metal and forms a nip on the peripheral surface of the developing roller 4. The supplying roller 5 rotates in an arrow E direction (counterclockwise direction) of FIG. 4. The supplying roller 5 supplies the toner 9, fed to the developing chamber 20*a*, to the developing roller 4 under application, from the developer supplying bias applying voltage source 106, of the developer supplying bias higher on the same polarity side as the normal charge polarity of the toner 9 than the potential of the developing roller 4.

The supplying roller 5 contacts the developing roller 4 with a predetermined penetration amount at a contact portion to the developing roller 4 and rotates so as to move in the same direction as the rotational direction of the developing roller 4 at the contact portion. The supplying roller 5 rotates at peripheral speed which is 1.5 times a peripheral speed of the developing roller 4, whereby supply of the toner 9 to the developing roller 4 and peeling-off of development residual toner from the developing roller 4 are carried out.

The regulating member 8 regulates a coating amount of the toner 9 supplied to the developing roller 4 by the supplying roller 5 and rubs the developing roller 4, so that the printing roller 4 is triboelectrically charged and thus electric charges are imparted to the developing roller 4.

In the developing chamber 20*a*, the developing roller 4 and the supplying roller 5 are provided.

The developer accommodating chamber 20*b* is disposed under the developing chamber 20*a*. In the developer accommodating chamber 20*b*, the toner 9 as the developer is accommodated.

Figure 4:
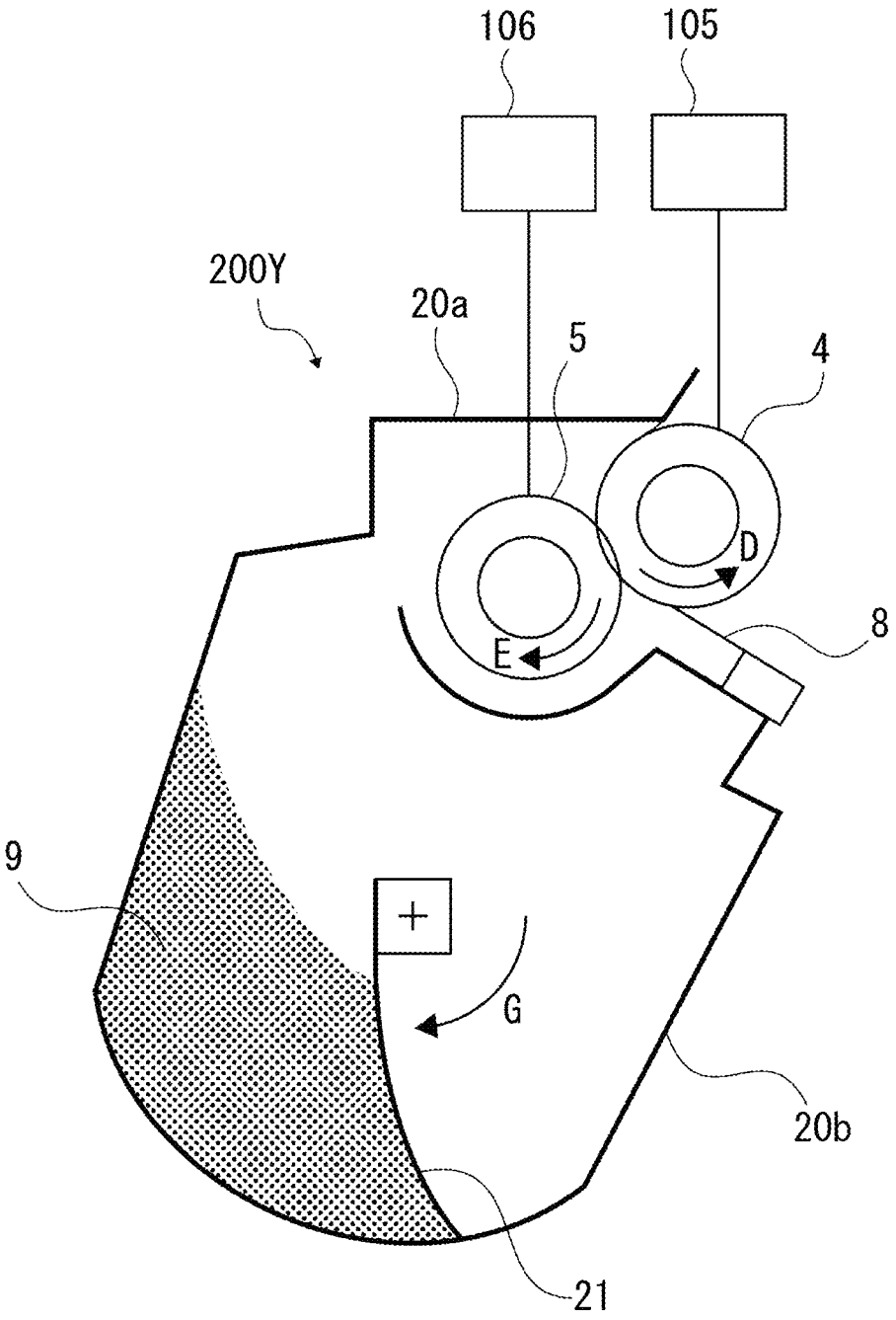
FIG. 4 is a schematic sectional view of a developing cartridge of the image forming apparatus according to the embodiment 1.

The developer feeding member 21 is provided in the developer accommodating chamber 20*b* and rotates in an arrow G direction of FIG. 4, so that the developer feeding member 21 feeds the toner 9, accommodated in the developer accommodating chamber 20*b*, to the developing chamber 20*a*.

Here, the toner 9 is non-magnetic spherical toner which is electrically charged to the negative polarity as the normal charge polarity and which is 7 μm in center particle size. Further, to the surface of the toner 9, as an external additive (external additive particles) for the toner, silica particles of 20 nm in particle size are added. Incidentally, the toner 9 is not limited to the toner charged to the negative polarity as the normal charge polarity.

<Occurring Mechanism of Improper Cleaning>

An occurring mechanism of improper cleaning in the image forming apparatus 100 according to the embodiment 1 of the present invention will be specifically described with reference to FIG. 5. Incidentally, FIG. 5 is an enlarged view of an edge portion of the cleaning blade 6.

The improper cleaning occurs due to that a part of the residual toner on the photosensitive drum 1 after the primary transfer is not removed.

Figure 5:
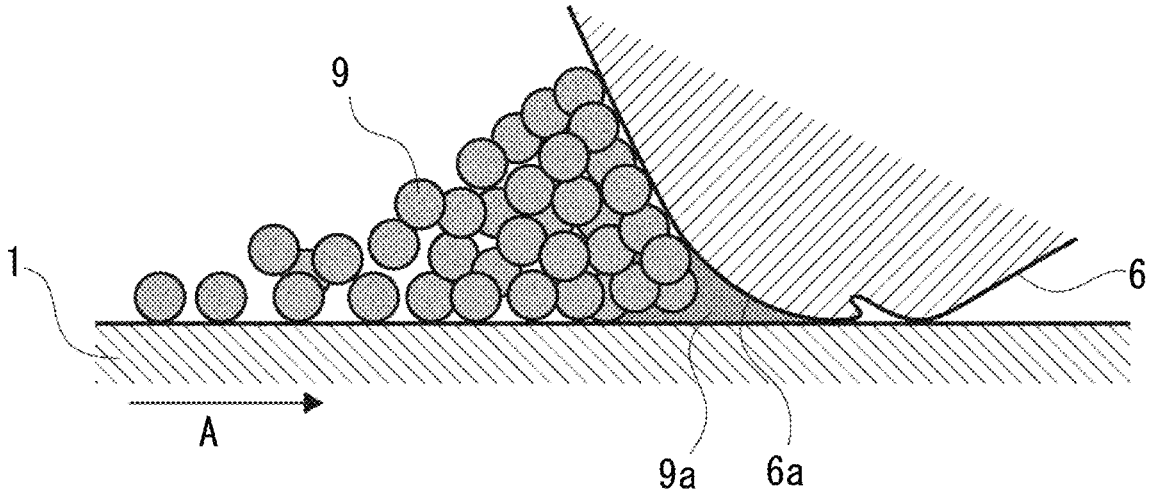
FIG. 5 is an enlarged view of an edge portion of a cleaning blade.

As shown in FIG. 5, the cleaning blade 6 contacts the photosensitive drum 1 in a counter direction to the rotational direction A of the photosensitive drum 1 and forms a wedge portion 6*a* in a state in which the edge portion of the cleaning blade 6 is dragged by the photosensitive drum 1 with rotation of the photosensitive drum 1. Then, at the wedge portion 6*a*, the above-described toner external additive transferred from the toner 9 stagnates, so that a blocking layer 9*a* is formed.

Here, in the case where the blocking layer 9*a* exists at the edge portion of the cleaning blade 6, the toner 9 does not enter the wedge portion 6*a*, so that cleaning performance is improved. On the other hand, the external additive forming the blocking layer 9*a* is about 20 μm in diameter, so that the external additive always passes through the cleaning blade 6 from the edge portion in a certain amount along the rotational direction A of the photosensitive drum 1. Then, in the case where the blocking layer 9*a* becomes small, the toner 9 is liable to enter the cleaning blade 6 through the wedge portion 6*a*, and therefore the improper cleaning is liable to occur.

Further, the toner 9 has a stronger depositing force onto the photosensitive drum 1 with a smaller particle size. Accordingly, with the smaller particle size of the toner 9, the toner 9 is liable to enter and break the blocking layer 9*a* with the rotation of the photosensitive drum 1, and therefore, there is a high possibility that the improper cleaning occurs. On the other hand, a high-print ratio image with a large print ratio is printed, a remaining amount of the toner 9 on the photosensitive drum 1 after the primary transfer is large, and therefore, the toner external additive is supplied in a large amount to the blocking layer 9*a*, so that the cleaning performance is improved.

Accordingly, in the case where a low-print ratio image with a small print ratio is printed, there is a need to suppress a fine powder amount of the toner 9 carried on the photosensitive drum 1, and therefore, the CPU 103 suppresses the fine powder amount of the toner 9 carried on the developing roller 4. Here, the fine powder amount of the toner 9 is an amount of the toner 9 comprising small particles of less than a predetermined value in circle-corresponding diameter.

<Occurring Mechanism of Improper Solid Followability>

An occurring mechanism of improper solid followability in the image forming apparatus 100 according to the embodiment 1 of the present invention will be specifically described.

The improper solid followability occurs due to that when the high-print ratio images are repetitively printed, the amount of the toner on the developing roller 4 becomes insufficient and thus the electrostatic latent images formed on the photosensitive drum 1 are not developed into the toner images of the toner 9 in a desired amount.

To the developing roller 4, the toner 9 is supplied from the supplying roller 5 under application of the developer supplying bias from the developer supplying bias applying voltage source 106 to the supplying roller 5. The amount of the toner 9 carried on the developing roller 4 during image formation changes depending on a developer supply amount control bias which is a difference between the developer supplying bias and the developing bias (this difference (bias) is referred to as a "Δ supplying bias"). Here, the/supplying bias is defined as: (Δ supplying bias (V))=(developer supplying bias (V))−(developing bias (V)). As regards the toner 9 with the negative polarity as the normal charge polarity, supply of the toner 9 from the supplying roller 5 to the developing roller 4 is aggressively performed by setting the developer supplying bias providing a negatively large potential difference relative to the developing bias.

Accordingly, when the high-print ratio images are repetitively printed, the improper solid followability occurs in the case where the Δ supplying bias is not sufficiently large on the negative polarity side.

Here, the case where the Δ supplying bias is made negative polarity refers to, for example, the case where the Δ supplying bias is made −50 V by not only setting the developer supplying bias at −400 V but also setting the developing bias at −350 V. Further, the case where the Δ supplying bias is made positive in polarity refers to, for example, the case where the Δ supplying bias is made +100 V by not only setting the developer supplying bias at −250 V but also setting the developing bias at −350 V.

<Relationship Between Δ Supplying Bias and Particle Size of Toner on Developing Roller)

A relationship between the Δ supplying bias and the particle size of the toner 9 on the developing roller 4 in the image forming apparatus 100, according to the embodiment 1 of the present invention will be specifically described with reference to FIG. 6.

At a contact portion between the supplying roller 5 and the developing roller 4, the supplying roller 5 supplies the toner 9 to the developing roller 4 and peels off the development residual toner from the developing roller 4. At this time, with a smaller particle size of the toner 9 on the developing roller 4, a depositing force of the toner 9 on the developing roller 4 becomes stranger, and therefore, the toner 9 is not readily peeled off of the developing roller 4. For that reason, in the case where the supply of the toner 9 by the supplying roller 5 and the peeling-off of the development residual toner by the supplying roller 5 are repeated, the particle size of the toner 9 carried on the developing roller 4 gradually becomes small. Further, in the case where the Δ supplying bias is made large on the negative polarity side, an amount in which the toner 9 is peeled off by the supplying roller 5 decreases, and therefore, the particle size of the toner 9 carried on the developing roller 4 becomes small.

On the other hand, in the case where the developer supplying bias providing a potential difference large on the positive polarity side relative to the developing bias is set, on the negatively chargeable toner 9, a force for moving the toner 9 from the developing roller 4 to the supplying roller 5 acts. Accordingly, by setting the Δ supplying bias to the positive polarity side, peeling-off of small-diameter toner 9 having a strong depositing force on the developing roller 4 becomes active, so that the particle size of the toner 9 carried on the developing roller 4 becomes large.

Figure 6:
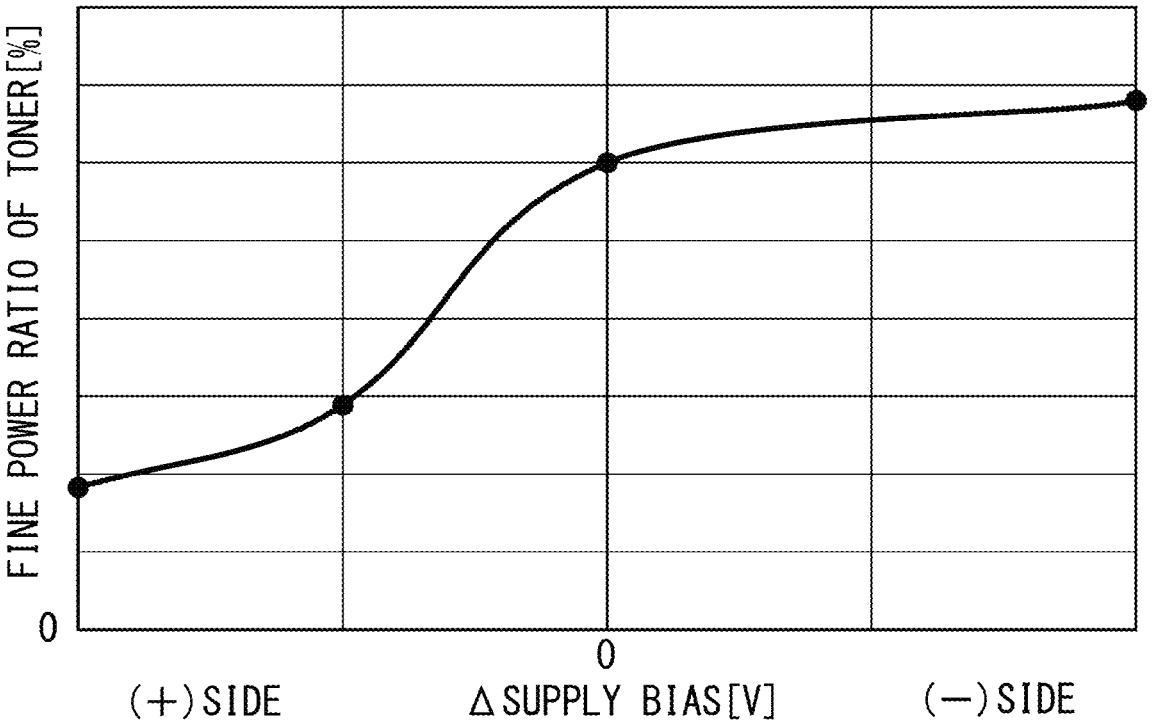
FIG. 6 is a graph showing a relationship between a fine powder ratio of toner on a developing member and a Δ supplying bias in the image forming apparatus according to the embodiment 1.

By this, a fine powder ratio of the toner 9 carried on the developing roller 4 is increased by setting the Δ supplying bias to the negative polarity side and is decreased by setting the Δ supplying bias to the positive polarity side as shown in FIG. 6. Thus, the Δ supplying bias and the particle size of the toner 9 carried on the developing roller 4 correlate with each other.

<Δ Supplying Bias Control Process>

A Δ supplying bias control process in the embodiment 1 of the present invention will be specifically described with reference to FIG. 7.

Figure 7:
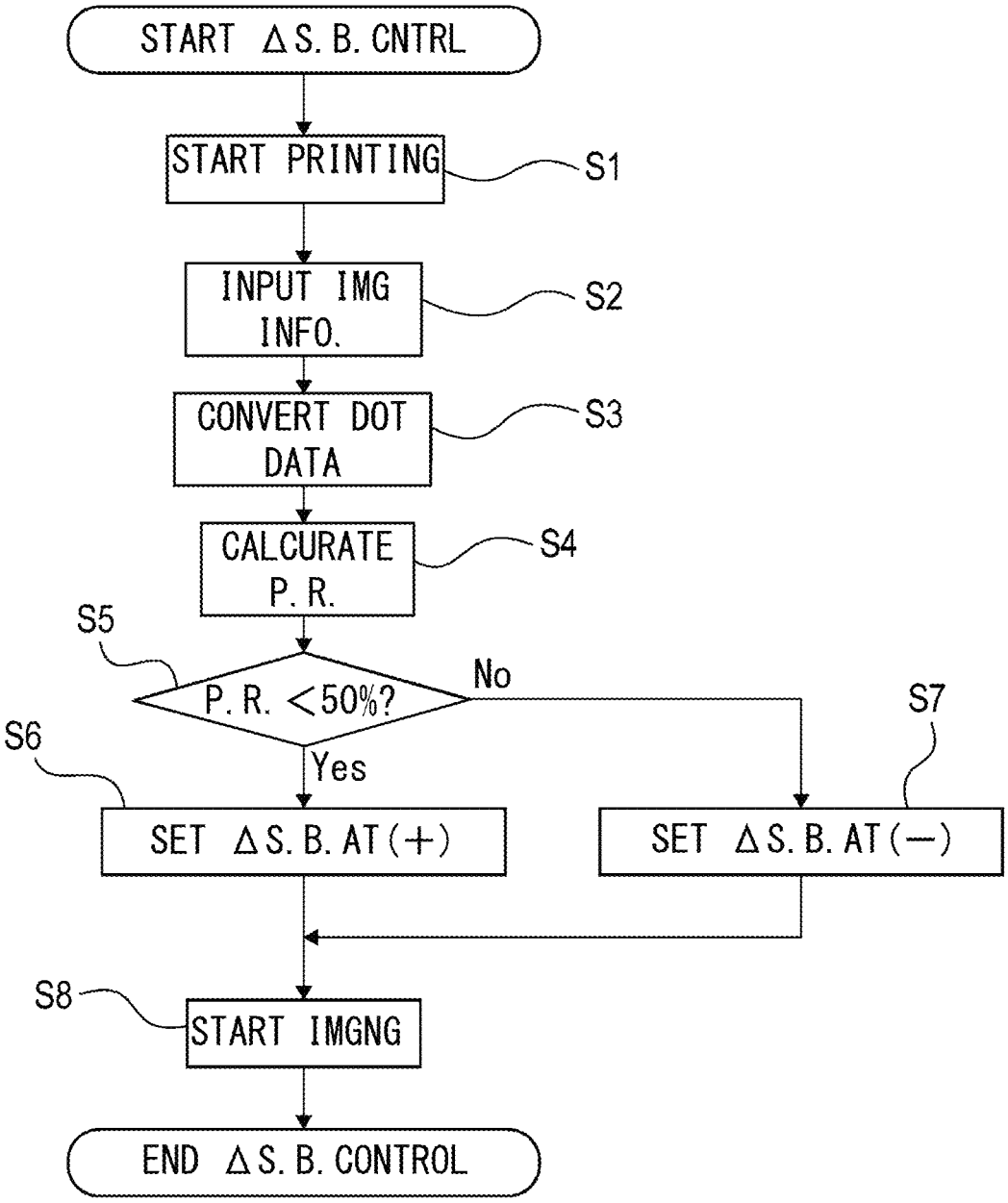
FIG. 7 is a flowchart of a Δ supplying bias control process in the embodiment 1.

The Δ supplying bias control process shown in FIG. 7 is started at timing when the image forming apparatus 100 receives an instruction to start a printing operation through an operation of an input device such as an unshown touch panel mounted on the image forming apparatus 100.

First, the image forming apparatus 100 starts the printing operation (S1).

Then, to the video controller 104, image information is inputted from the host device 107 (S2).

Then, the half-tone processing portion 402 of the video controller 104 converts the image information into dot data (S3).

Then, the print ratio calculating portion 403 of the video controller 104 calculates a print ratio on the basis of the dot data (S4).

Then, the CPU 103 of the engine controller 101 discriminates whether or not the print ratio is less than 50% (less than threshold) which is a threshold (S5).

In the case where the print ratio is less than 50% (S5: YES), there is a possibility that the improper cleaning occurs due to the printing of the low-print ratio image, and therefore, the CPU 103 controls the developer supplying bias applying voltage source 106 and thus sets the polarity of the Δ supplying bias at the positive polarity (S6).

On the other hand, in the case where the print ratio is 50% or more (threshold or more) (S5: No), there is a possibility that the improper solid followability occurs due to the printing of the high-print ratio image, and therefore, the CPU 103 controls the developer supplying bias applying voltage source 106 and thus sets the polarity of the Δ supplying bias at the negative polarity (S7).

Then, the image forming apparatus 100 starts the image formation (S8), and ends the Δ supplying bias control process after ends the image formation.

Thus, every reception of the instruction to start the printing operation, the CPU 103 executes the Δ supplying bias control process for controlling the A supplying bias depending on the print ratio, whereby the CPU 103 is capable of suppressing the improper cleaning and the improper solid followability.

In the above-described Δ supplying bias control process, the CPU 103 changes the polarity of the Δ supplying bias by controlling the developing bias applied from the developing bias applying voltage source 105 to the developing roller 4. Or, the CPU 103 changes the polarity of the Δ supplying bias by controlling the developer supplying bias applied from the developer supplying bias applying voltage source 106 to the supplying roller 5.

Incidentally, in the above-described Δ supplying bias control process, the case where the print ratio is 50% or more is used as the case of the high print ratio and the case where the print ratio of less than 50% is used as the case of the low print ratio, but the present invention is not limited thereto. A predetermined threshold other than 50% can also be set.

Further, in the above-described Δ supplying bias control process, a region of the photosensitive drum 1 with respect to a longitudinal direction is divided into a plurality of regions, and a threshold for being compared with the print ratio may also be set for each of the divided regions.

Further, in the above-described Δ supplying bias control process, the polarity of the Δ supplying bias is changed depending on the print ratio, but the present invention is not limited thereto. A magnitude of the Δ supplying bias may also be changed depending on the print ratio. For example, the Δ supplying bias may also be set at +100 V in the case of (print ratio)<20%, +50 V in the case of 20%<(print ratio)<40%, 0 V in the case of 40%<(print ratio)<60%, −50 V in the case of 60%<(print ratio)<80%, and −100 V in the case of 80% (print ratio).

In the above-described Δ supplying bias control process, depending on the print ratio, the Δ supplying bias may also be changed linearly.

In the above-described Δ supplying bias control process, the polarity of the Δ supplying bias is changed depending on the print ratio, but the present invention is not limited thereto. The polarity of the Δ supplying bias may also be changed depending on the print ratio during the image formation on the recording material 12.

<Comparison of Effects Between Embodiment 1 and Comparison Examples 1 and 2>

Next, comparison of effects between the embodiment 1 (this embodiment) and comparison examples 1 and 2 will be specifically described with reference to FIG. 8.

FIG. 8 shows a high and a low of the print ratio, and occurrence or non-occurrence of the improper cleaning and the improper solid followability depending on the polarity of the Δ supplying bias in each of the embodiment 1, the comparison example 1 and the comparison example 2. Incidentally, in FIG. 8, "OK" represents that the improper cleaning or the improper solid followability does not occur.

Here, in the comparison example 1, the polarity of the Δ supplying bias is not changed depending on the print ratio, and the polarity of the Δ supplying bias during the image formation is set at the negative polarity. Further, in the comparison example 2, the polarity of the Δ supplying bias is not changed depending on the print ratio, and the polarity of the Δ supplying bias during the image formation is set at the positive polarity.

In this case, in the comparison example 1, a small-particle size toner 9 is carried on the developing roller 4 when the low-print ratio image is printed. Further, in the comparison example 2, the small-particle size toner 9 is not readily carried on the developing roller 4 when the high-print ratio image is printed.

By this, as shown in FIG. 8, in the comparison example 1, the improper cleaning occurred when the low-print ratio image is printed. Further, in the comparison example 2, the improper solid followability occurred when the high-print ratio image is printed. On the other hand, in the embodiment 1 (this embodiment), the improper cleaning and the improper solid followability did not occur by changing the polarity of the Δ supplying bias depending on the print ratio. By this, compared with the comparison examples 1 and 2, superiority of the embodiment 1 can be confirmed.

Thus, according to this embodiment, by changing the polarity of the A supplying bias depending on the print ratio, it is possible to suppress the improper cleaning and the improper solid followability of the photosensitive drum 1.

Embodiment 2

<Image Forming Apparatus>

A structure of an image forming apparatus 500 according to an embodiment 2 of the present invention will be specifically described with reference to FIG. 9.

Figure 2:
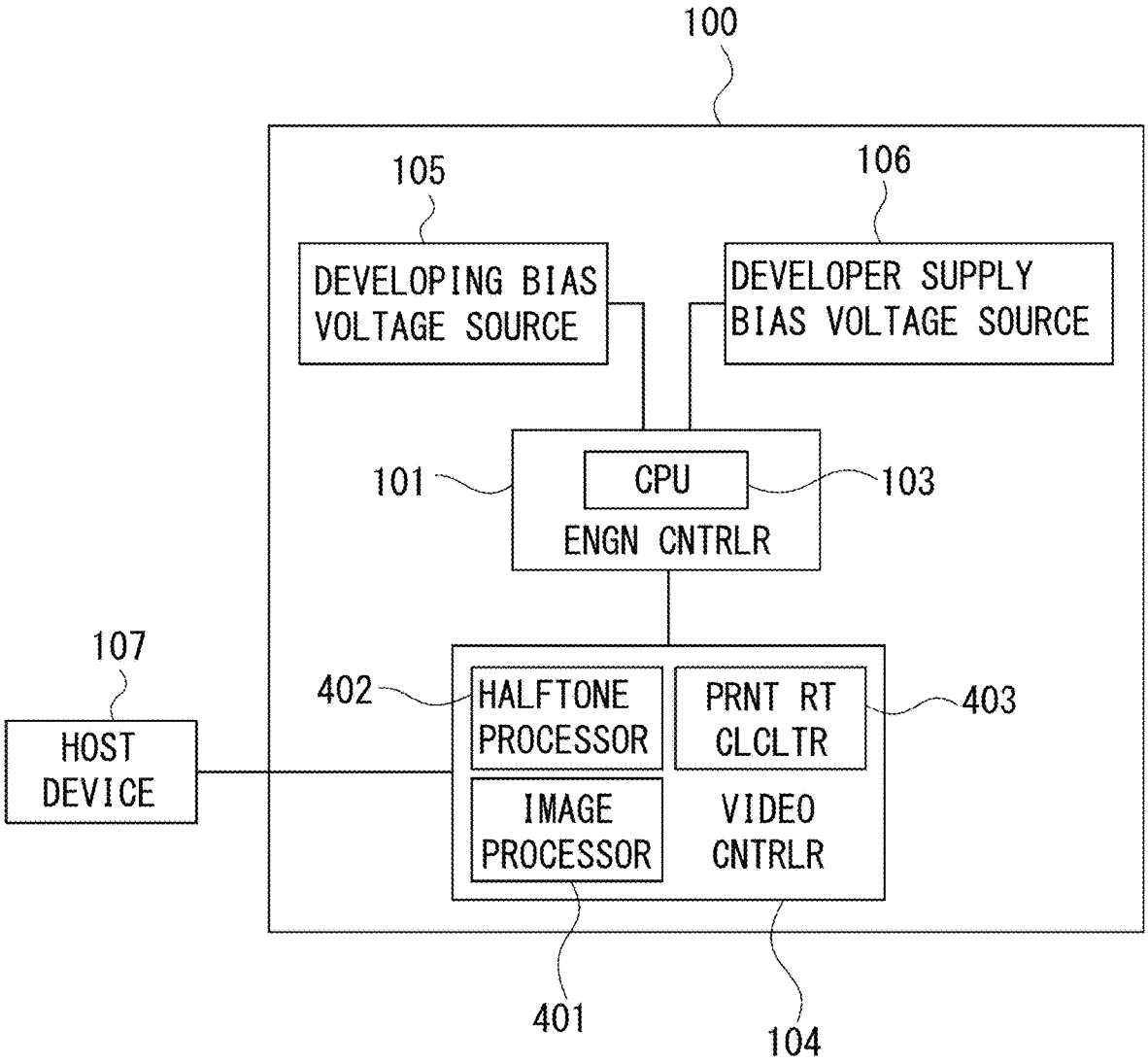
FIG. 2 is a block diagram showing a constitution of the image forming apparatus according to the embodiment 1.
Figure 9:
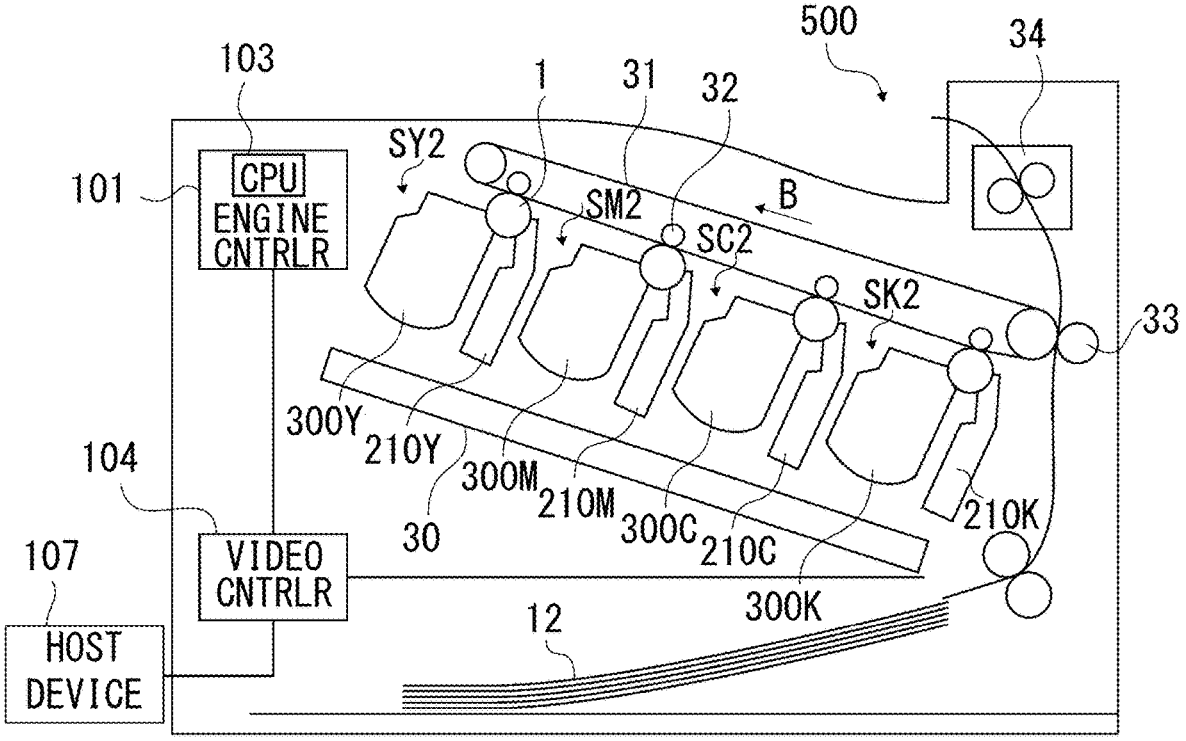
FIG. 9 is a schematic view of an image forming apparatus according to an embodiment 2.

Incidentally, in FIG. 9, portions having the same structures as those in FIG. 1 are represented by the same reference numerals or symbols and will be omitted from description.

The image forming apparatus 500 includes a scanner unit 30, an intermediary transfer belt 31, primary transfer rollers 32, a secondary transfer roller 33 and a fixing portion 34. Further, the image forming apparatus 500 includes an engine controller 101, a CPU 103, a video controller 104, a developing bias applying voltage source 105, a developer supplying bias applying voltage source 106, and image forming portions SY2, SM2, SC2 and SK2.

The scanner unit 30 is an exposure device provided at a periphery of photosensitive drums 1 of the image forming portions SY2, SM2, SC2 and SK2, and forms electrostatic images (electrostatic latent images) by irradiating surfaces of the photosensitive drums 1 with laser light on the basis of image information. By this, the scanner unit 30 is capable of performing the laser light exposure always in the same position on the photosensitive drum 1 in each of the image forming portions SY1, SM1, SC1 and SK1 which are four process stations.

The intermediary transfer belt 31 is formed with an endless belt and contacts all the photosensitive drums 1, The primary transfer rollers 32 successively primary-transfer superposedly, onto the intermediary transfer belt 31, the respective color toner images formed on the photosensitive drums 1 by predetermined processes successively performed in the image forming portions SY2, SM2, SC2 and SK2 during full-color image formation.

The image forming portions SY2, SM2, SC2 and SK2 are disposed in a line along a direction crossing a vertical direction and from the toner images of yellow (Y), magenta (M), cyan (C) and black (K), respectively, on the intermediary transfer belt 31. Each of the image forming portions SY2, SM2, SC2 and SK2 is mountable in and dismountable from the image forming apparatus 500 through unshown mounting means such as a mounting guide and a positioning member which are provided in a main assembly of the image forming apparatus 100.

The image forming portions SY1, SM1, SC1 and SK1 include drum cartridges 210Y, 210M, 210C and 210K and developing cartridges 300Y, 300M, 300C and 300K, respectively.

All the developing cartridges 300Y, 300M, 300C and 300K have the same shape. In the developing cartridges 300Y, 300M, 300C and 300K, toners of yellow (Y), magenta (M), cyan (C) and black (K) are accommodated, respectively.

The drum cartridges 210Y, 210M, 210C and 210K have lifetimes twice lifetimes of the developing cartridges 300Y, 300M, 300C and 300K. The CT layers of the drum cartridges 210Y, 210M, 210C and 210K have thicknesses depending on the lifetimes of the drum cartridges 210Y, 210M, 210C and 210K and the thicknesses are 25 μm, for example.

<Developing Cartridge>

Figure 10:
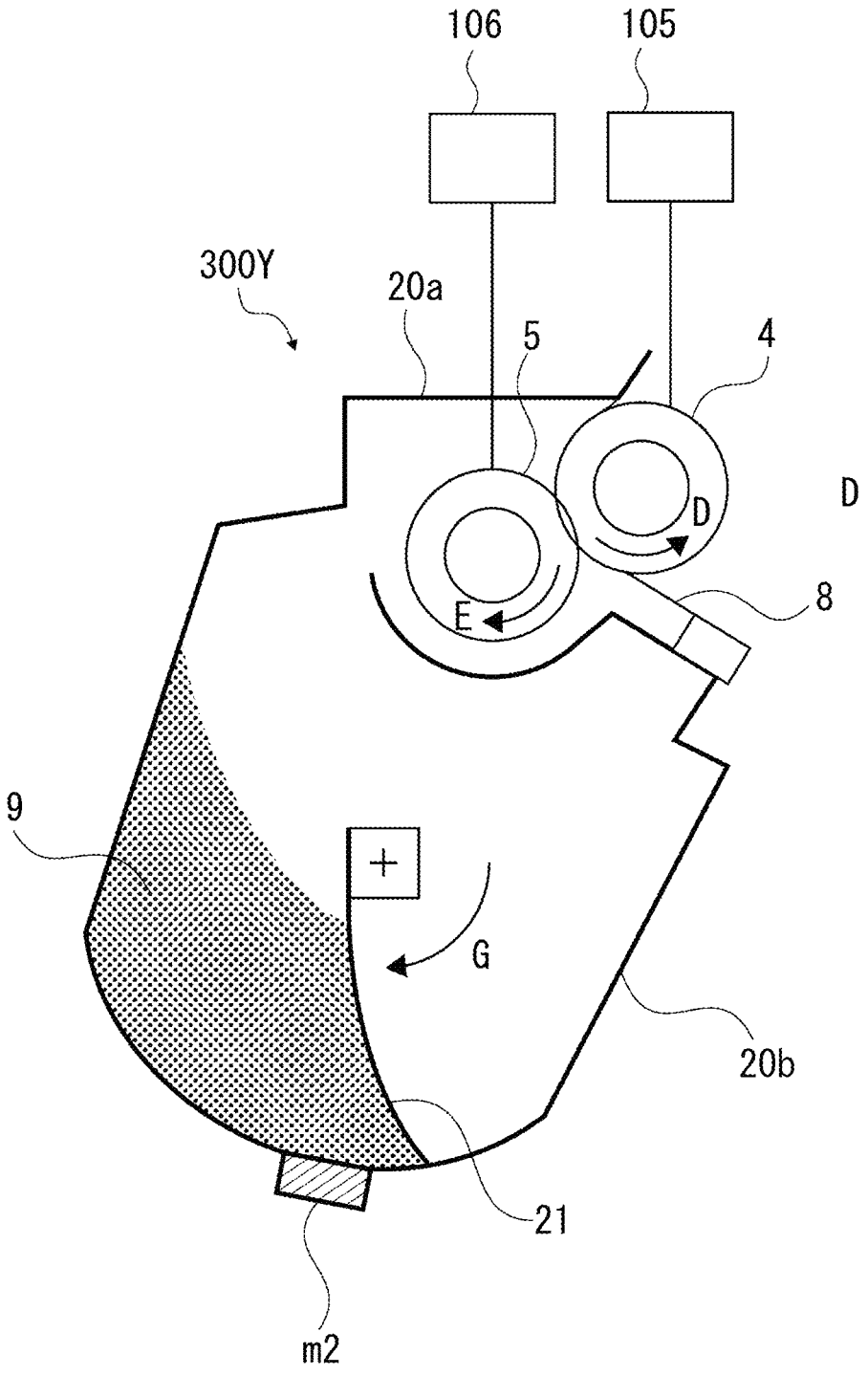
FIG. 10 is a schematic view of a developing cartridge of the image forming apparatus according to the embodiment 2.

A structure of each of the developing cartridges 300Y, 300M, 300C and 300K which are mounted in the image forming apparatus 500 according to the embodiment 1 of the present invention will be specifically described with reference to FIG. 10. Incidentally, each of the developing cartridges 200Y, 200M, 200C and 200K has the same shape, and therefore, only the structure of the developing cartridge 200Y will be described. Incidentally, in FIG. 10, portions having the same structures as those in FIG. 1 are represented by the same reference numerals or symbols and will be omitted from description.

The developing cartridge 200Y includes the developing roller 4, the supplying roller 5, a regulation member 8, a developing chamber 20*a*, a developer accommodating chamber 20*b*, and a developer feeding member 21, and a non-volatile memory m2.

In the non-volatile memory m2, pieces of information on the number of rotations of the photosensitive drum 1 for grasping a use amount of the drum cartridge 210Y and on a production number and the like are stored. The non-volatile memory m1 contacts the CPU 103 of the engine controller 101 or contacts an electric contact toward the CPU 103, and thus is capable of communicating with the CPU 103, so that writing and reading of the information are carried out.

<Occurring Mechanism of Turning-Up of Cleaning Blade>

An occurring mechanism of timing-up of the cleaning blade 6 in the image forming apparatus 500 according to the embodiment 2 of the present invention will be specifically described.

The turning-up of the cleaning blade 6 occurs in the case where a frictional force between the cleaning blade 6 and the photosensitive drum 1 is large.

The cleaning blade 6 contacts the photosensitive drum 1 in the counter direction to the rotational direction of the photosensitive drum 1, and therefore, in the case where surface roughness of the photosensitive drum 1 is small, the frictional force between itself and the photosensitive drum 1 becomes large, so that the turning-up of the cleaning blade occurs in some instances. Further, even in the case where the surface roughness of the photosensitive drum 1 is small, the frictional force between the cleaning blade 6 and the photosensitive drum 1 becomes low when an amount of the blocking layer 9*a* is sufficient, so that the turning-up of the cleaning blade 6 does not occur.

Further, when the low-print ratio image is printed in the case where the thickness of the photosensitive drum 1 is large, an amount of the toner with which the electrostatic latent image is developed at the non-exposure portion of the photosensitive drum 1 (hereinafter, this toner is referred to as "fog toner") is small, and therefore, the toner amount on the photosensitive drum 1 decreases, so that the amount of the external additive forming the blocking layer does not exist. For that reason, in the case where the thickness of the photosensitive drum 1 is large, when the low-print ratio image is printed, the turning-up of the cleaning blade 6 occurs in some instances. Here, the fog toner is the toner 9 which has been positively charged.

As regards the drum cartridges 210Y, 210M, 210C and 210K, in the case where those having long lifetimes are used, photosensitive drums 1 having a large thickness and a high surface hardness are used in a fresh (brand-new) state. Further, in the case where fresh developing cartridges 300Y, 300M, 300C and 300K are used, the fog toner amount decreases. For that reason, in the case where the fresh drum cartridges 210, 210M, 210C and 210K and the fresh developing cartridges 300Y, 300M, 300C and 300K are used in combination, there is a possibility that the turning-up of the cleaning blade 6 occurs. Accordingly, in this case, in order to sufficiently ensure the amount of the blocking layer 9*a*, there is a need to increase the amount of the toner 9 on the photosensitive drum 1.

<Relationship Between Δ Supplying Bias and Fog Amount)

Figure 11:
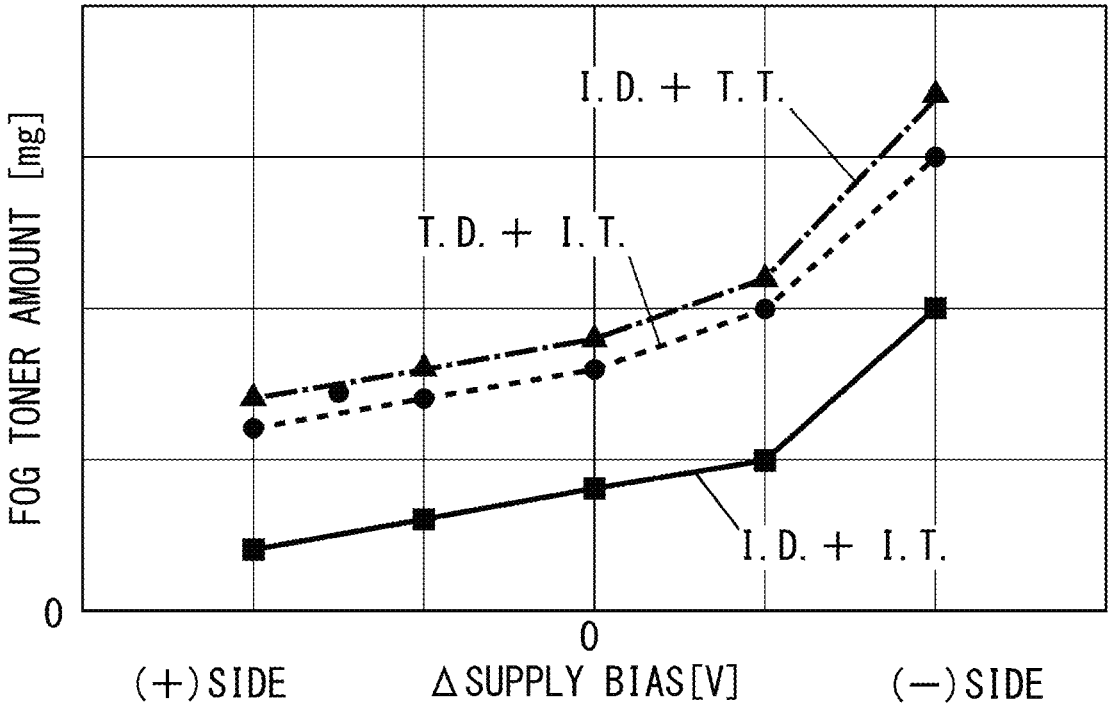
FIG. 11 is a graph showing a relationship between a fog amount of a photosensitive drum and a Δ supplying bias in the image forming apparatus according to the embodiment 2.

A relationship between the Δ supplying bias and a fog toner amount in the image forming apparatus 500, according to the embodiment 2 of the present invention will be specifically described with reference to FIG. 11.

In the case where the Δ supplying bias is high on the negative polarity side, the amount of the toner 9 supplied from the supplying roller 5 to the developing roller 4 increases, and therefore, the developing roller 4 passes through the regulating member 8 in a state in which the developing roller 4 carries the toner 9 in a large amount. In this case, on the developing roller 4, the amount of the toner 9 to which the electric charges are not sufficiently imparted increases, so that an amount of the positively charged toner 9 or an amount of the toner 9 with small negative electric charges increases.

The positively charged toner 9 or the toner 9 with the small negative electric charges has a non-exposure portion potential of the photosensitive drum 1, which is higher than the developing bias on the negative polarity side, and therefore, the electrostatic latent image is developed with the toner 9 at the non-exposure portion of the photosensitive drum 1. For that reason, the amount of the fog toner on the photosensitive drum 1 becomes large in the case where the Δ supplying bias is high on the negative polarity side, as shown in FIG. 11. Thus, the amount of the fog toner on the photosensitive drum 1 is determined by a magnitude of the electric charges of the toner 9 carried on the developing roller 4.

Further, in each of the developing cartridges 300Y, 300M, 300C and 300K, the toner 9 accommodated therein is deteriorated with use, so that charging performance of the toner 9 lowers. For that reason, in the case where the developing cartridges 300Y, 300M, 300C and 300K which are not fresh developing cartridges are used, the amount of the toner on the photosensitive drum 1 becomes large.

Further, at a contact portion between the developing roller 4 and the photosensitive drum 1, the electric charges of the toner carried on the developing roller 4 flow toward the photosensitive drum 1 side. At this time, the thickness of the CT layer of the photosensitive drum 1 gradually becomes small (thin) as the photosensitive drum 1 is used. The photosensitive drum 1 including the CT layer having the small thickness is low in resistance, and therefore, the electric charges of the toner carried on the developing roller 4 become small, so that the amount of the fog toner becomes large.

By this, in the case where the fresh drum cartridges 210Y, 210M, 210C and 210K and the fresh developing cartridges 300Y, 300M, 300C and 300K are used in combination, the amount of the fog toner on each of the photosensitive drums 1 is small. Further, in this combination, the amount of the toner on each of the photosensitive drums 1 is increased by setting the Δ supplying bias to the negative polarity side.

<Setting of Δ Supplying Bias Depending on Print Ratio and Use State of Cartridge>

Next, setting of the Δ supplying bias depending on the print ratio and a use state (lifetime) of the cartridge in the image forming apparatus 500 according to the embodiment 2 of the present invention will be specifically described with reference to FIG. 12.

As described above, in the image forming apparatus 500, there is a possibility that the turning-up of the cleaning blade 6, the improper solid followability and the improper cleaning occur.

There is a possibility that the turning-up of the cleaning blade 6 occurs when the low-print ratio image are printed in combination of fresh drum cartridges 210Y, 210M, 210C and 210K with fresh developing cartridges 300Y, 300M, 300C and 300K. Further, there is a possibility that the improper solid followability occurs in the case where the high-print ratio images are printed.

Further, there is a possibility that the improper cleaning occurs when the low-print ratio images are printed in the case where the drum cartridges 210Y, 210M, 210C and 210K which are not fresh (new) ones are used. On the other hand, the improper cleaning does not occur in the case where the fresh drum cartridges 210Y, 210M, 210C and 210K in which surface roughness of each of the photosensitive drums 1 is small since a toner feeding force of each of the photosensitive drum 1 is sufficiently small.

By this, in this embodiment, the CPU 103 controls the developer supplying bias applying voltage source 106 and sets the Δ supplying bias as shown in FIG. 12. Specifically, the CPU 103 always sets the Δ supplying bias to the negative polarity side in the case where the fresh drum cartridges 210Y, 210M, 210C and 210K and the fresh developing cartridges 300Y, 300M, 300C and 300K are used in combination. On the other hand, in the cases other than this case, the CPU 103 sets the Δ supplying bias to the positive polarity side when the low-print ratio image is printed and sets the Δ supplying bias to the negative polarity side when the high-print ratio image is printed.

Here, as regards the drum cartridges 210Y, 210M, 210C and 210K, those from a fresh (brand-new) state until the images are printed on 1000 sheets are referred to as the "fresh" drum cartridges, and those for printing of the images on a 1001-th sheet and later are referred to as used drum cartridges. Incidentally, discrimination as to whether or not the drum cartridges 210Y, 210M, 210C and 210K are the fresh drum cartridges is not limited thereto, a threshold thereof may be set at the number of sheets other than the 1000 sheets. Further, the above-described discrimination may also be made by utilizing a use state in terms of the lifetimes of the drum cartridges 210Y, 210M, 210C and 210K.

Further, in this embodiment, depending on the use state of the cartridge, a magnitude of the Δ supplying bias may also be changed. For example, as the use state, the lifetime is divided into lifetime regions of less than 1000 sheets, 1000 sheets or more and less than 5000 sheets, 5000 sheets or more and less than 10000 sheets, and 10000 sheets or more, and the Δ supplying bias depending on the print ratio in each of the divided lifetime regions may also be set.

Further, in this embodiment, depending on the use state of the cartridge, the Δ supplying bias may also be linearly set.

<Δ Supplying Bias Control Process>

A Δ supplying bias control process in the embodiment 2 of the present invention will be specifically described with reference to FIG. 13.

Figure 13:
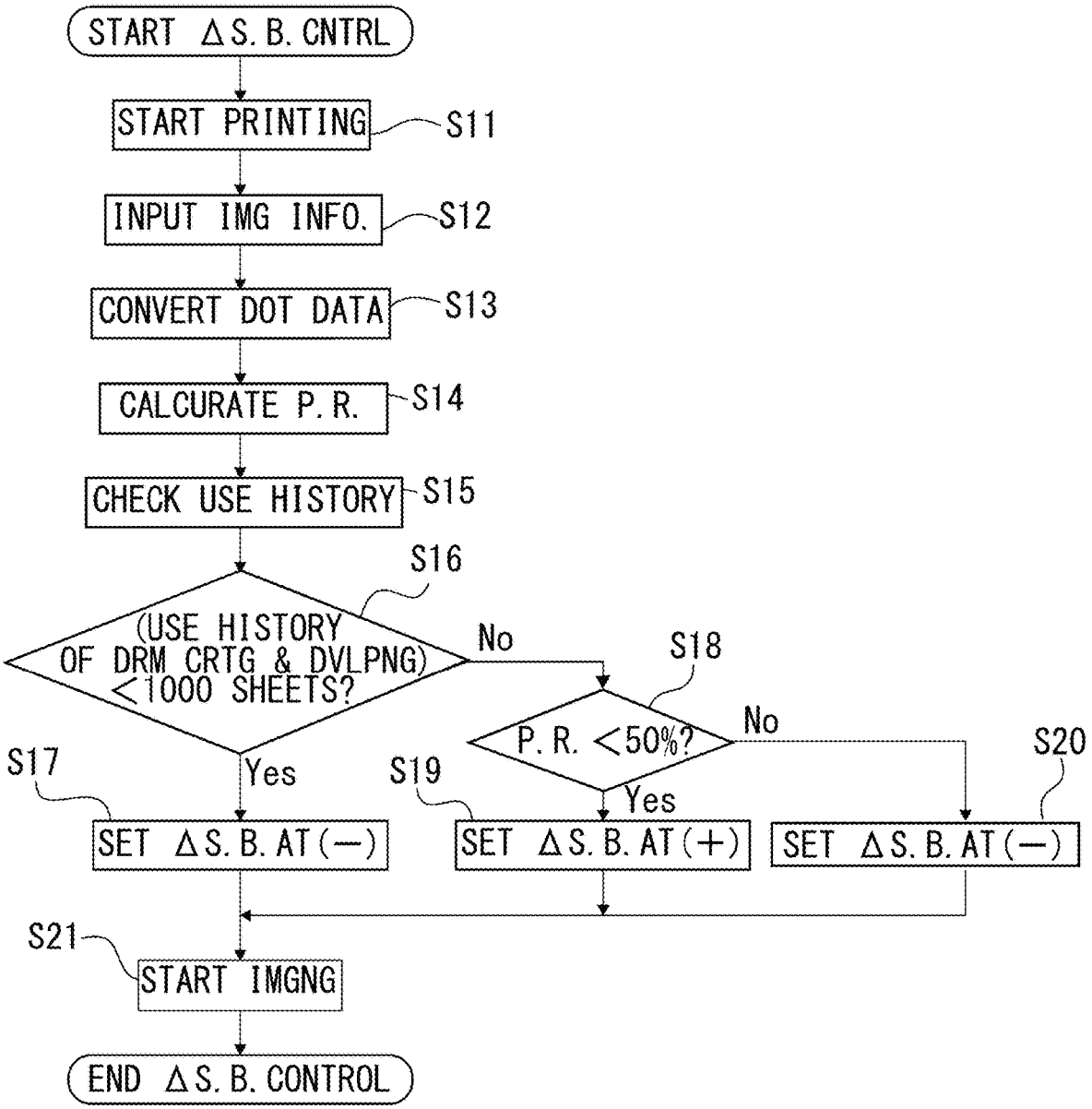
FIG. 13 is a flowchart of a Δ supplying bias control process in the embodiment 2.

The Δ supplying bias control process shown in FIG. 13 is started at timing when the image forming apparatus 500 receives an instruction to start a printing operation through an operation of an input device such as an unshown touch panel mounted on the image forming apparatus 500.

First, the image forming apparatus 500 starts the printing operation (S11).

Then, to the video controller 104, image information is inputted from the host device 107 (S12).

Then, the half-tone processing portion 402 of the video controller 104 converts the image information into dot data (S13).

Then, the print ratio calculating portion 403 of the video controller 104 calculates a print ratio on the basis of the dot data (S14).

Next, the CPU 103 of the engine controller 101 check use histories of the drum cartridges 210Y, 210M, 210C and 210K and the developing cartridges 300Y, 300M, 300C and 300K (S15). Here, the use history is the use state when the images are formed on the recording materials 12. Further, the use history may also be the use history of one of the drum cartridge and the developing cartridge.

Then, the CPU 103 discriminates whether or not values indicating the use histories of the drum cartridges 210Y, 210M, 210C and 210K and the developing cartridges 300Y, 300M, 300C and 300K are not more than 1000 sheets as a predetermined value (S16). Here, the value indicating the use history is the number of sheets of the recording materials 12 subjected to the image formation.

In the case where the value indicating the use history is not more than 1000 sheets (S16: Yes), the CPU 103 discriminates that the fresh drum cartridges 210Y, 210M, 210C and 210K and the fresh developing cartridges 300Y, 300M, 300C and 300K are used in combination. Then, there is a possibility that the turning-up of the cleaning blade 6 occurs, and therefore, the CU 103 sets the A supplying bias to a negative value in order sufficiently ensure an amount of the blocking layer 9*a* at the edge portion of the cleaning blade 6 by increasing the toner amount on the photosensitive drum 1 (S17).

On the other hand, in the case where at least one of the values indicating the use histories of the drum cartridge and the developing cartridge is more than 1000 sheets (S16: No), the CPU 103 discriminates whether or not the print ratio is less than 50% (S18).

In the case where the print ratio is less than 50% (S18: YES), there is a possibility that the improper cleaning occurs due to the printing of the low-print ratio image, and therefore, the CPU 103 sets the polarity of the Δ supplying bias at the positive polarity (S19).

On the other hand, in the case where the print ratio is 50% or more (S18: No), there is a possibility that the improper solid followability occurs due to the printing of the high-print ratio image, and therefore, the CPU 103 sets the polarity of the Δ supplying bias at the negative polarity (S20).

Then, the image forming apparatus 500 starts the image formation (S21), and ends the Δ supplying bias control process after ends the image formation.

Thus, the CPU 103 sets the Δ supplying bias depending on the print ratio and the use state of the cartridge, whereby the CPU 103 is capable of suppressing the turning-up of the cleaning blade 6, the improper cleaning and the improper solid followability.

In the above-described Δ supplying bias control process, the value indicating the use history and the predetermined value compared when the use history is checked are stored in advance in each of the non-volatile memory m1 as a first storing means and the non-volatile memory m2 as a second storing means.

<Comparison of Effects Between Embodiment 2 and Comparison Examples 3 and 4>

Next, comparison of effects between the embodiment 2 (this embodiment) and comparison examples 3 and 4 will be specifically described with reference to FIGS. 14 to 16.

FIGS. 14 to 16 show the use state of the cartridge, a high and a low of the print ratio, the turning-up of the cleaning blade 6 and occurrence or non-occurrence of the improper cleaning and the improper solid followability depending on the polarity of the Δ supplying bias. Incidentally, in FIGS. 14 to 16, "OK" represents that the turning-up of the cleaning blade 6, the improper cleaning or the improper solid followability does not occur.

Here, in the comparison example 3, the Δ supplying bias is not set depending on the use state of the cartridge and the print ratio, and the polarity of the Δ supplying bias is set at the negative polarity. Further, in the comparison example 4, the Δ supplying bias is not set depending on the use state of the cartridge and the print ratio, and the polarity of the Δ supplying bias is set at the positive polarity.

By this, as shown in FIG. 15, in the comparison example 3, the improper cleaning occurred when the used drum cartridge is used and the low-print ratio image is printed. In the comparison example 4, as shown in FIG. 16, the turning-up of the cleaning blade 6 occurred when the fresh drum cartridge and the fresh developing cartridge are used in combination and the low-print ratio image is printed. Further, in the comparison example 4, the improper solid followability occurred when the high-print ratio image is printed.

On the other hand, in the embodiment 2 (this embodiment), as shown in FIG. 14, the turning-up of the cleaning blade 6, the improper cleaning and the improper solid followability did not occur by changing the polarity of the A supplying bias depending on the use state of the cartridge and the print ratio. By this, compared with the comparison examples 3 and 4, superiority of the embodiment 1 can be confirmed.

In this embodiment, the polarity of the Δ supplying bias is changed depending on the use state of the drum cartridges 210Y, 210M, 210C and 210K and the developing cartridges 300Y, 300M, 300C and 300K, and the print ratio. By this, in addition to the effect of the above-described embodiment 1, the turning-up of the cleaning blade 6 can be suppressed.

The present invention is not limited to the above-described embodiments and is capable of being variously modified without departing from the scope of the present invention.

Specifically, in the above-described embodiments 1 and 2, the four process cartridges are provided so as to be mountable in and dismountable from the main assembly of the image forming apparatus, but the number of the process cartridges are not limited to four.

Thus, according to the present invention, by changing the polarity of the difference between the developing bias and the Δ supplying bias depending on the print ratio, it is possible to suppress the improper cleaning and the improper solid followability of the image bearing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-030499 filed on Feb. 26, 2020, which is hereby incorporated by reference herein in its entirety.

What is claimed is:

1. An image forming apparatus comprising:

a main assembly;

a first cartridge including an image bearing member on which an electrostatic latent image based on image data inputted from an outside, said first cartridge being mountable in and dismountable from said main assembly;

a second cartridge including a developing member for developing the electrostatic latent image with a developer under application of a developing bias, said second cartridge being mountable in and dismountable from said main assembly;

a developer supplying member provided in said second cartridge and configured to supply the developer to said developing member under application of a developer supplying bias; and a controller configured to change a polarity of a developer supply amount control bias which is a difference between the developing bias and the developer supplying bias, depending on a print ratio based on the inputted image data, wherein said controller changes the polarity of the developer supply amount control bias depending on at least one of a use history of said first cartridge and a use history of said second cartridge and on the print ratio.

2. An image forming apparatus according to claim 1, wherein said controller changes the polarity of the developer supply amount control bias by controlling the developing bias applied to said developing member.

3. An image forming apparatus according to claim 1, wherein said controller changes the polarity of the developer supply amount control bias by controlling the developer supplying bias applied to said developer supplying member.

4. An image forming apparatus according to claim 1, wherein when the print ratio is a threshold or more, said controller sets the developer supply amount control bias of the polarity for supplying the developer from said developer supplying member to said developing member, and when the print ratio is less than the threshold, said controller sets the developer supply amount control bias of the polarity for supplying the developer from said supplying member to said developer supplying member.

5. An image forming apparatus according to claim 1, wherein said controller changes the developer supply amount control bias depending on the print ratio during image formation on a recording material.

6. An image forming apparatus according to claim 1, wherein when a value indicating the use history of said first cartridge is a predetermined value or less and a value indicating a use history of said second cartridge is the predetermined value or less, said controller sets the developer supply amount control bias of the polarity for supplying the developer from said developer supplying member to said developing member irrespective of the print ratio.

7. An image forming apparatus according to claim 1, wherein when a value indicating a use history of said first cartridge is a predetermined value or less and the print ratio is less than a threshold, said controller sets the developer supply amount control bias of the polarity for supplying the developer from said developer supplying member to said developing member.

8. An image forming apparatus according to claim 6, wherein said first cartridge includes first storing means configured to store the use history of said first cartridge and a predetermined value compared with a value indicating the use history of said first cartridge, and wherein said first cartridge includes second storing means configured to store the use history of said second cartridge and a predetermined value compared with a value indicating the use history of said second cartridge.

* * * * *